US005884678A

United States Patent [19]

Chudy

[11] Patent Number: 5,884,678

[45] Date of Patent: Mar. 23, 1999

[54] CONNECTOR DEVICE FOR HOLDING TWO NECKS IN AN ABUTTING RELATIONSHIP

[76] Inventor: Dennis J. Chudy, 318 Marion Ave., Webster Groves, Mo. 63119

[21] Appl. No.: 775,006

[22] Filed: Dec. 27, 1996

[51] Int. Cl.[6] ..... B65B 39/00

[52] U.S. Cl. ..... 141/319; 141/364; 141/375; 141/384; 285/235

[58] Field of Search ..... 141/319, 364, 141/375, 384; 211/74

[56] References Cited

U.S. PATENT DOCUMENTS

| | | | |
|---|---|---|---|
| 2,749,004 | 6/1956 | Hilts et al. | 141/375 |
| 2,773,521 | 12/1956 | Persson | 141/364 |
| 3,156,272 | 11/1964 | Indrunas | 141/319 |
| 3,169,562 | 2/1965 | Gogel | 141/384 |
| 3,261,381 | 7/1966 | Roach | 141/319 |
| 3,615,150 | 10/1971 | Indrunas | 141/375 |
| 3,620,267 | 11/1971 | Seablom | 141/364 |
| 3,731,718 | 5/1973 | Gramig | 141/384 |
| 3,860,048 | 1/1975 | White | 141/375 |
| 3,877,499 | 4/1975 | Fluster | 141/364 |
| 3,945,617 | 3/1976 | Callery | 141/364 |
| 4,217,941 | 8/1980 | Catalano | 141/375 |
| 4,271,878 | 6/1981 | Bologa | 141/375 |
| 4,347,879 | 9/1982 | Blaser | 141/364 |
| 4,454,897 | 6/1984 | Valiant | 141/364 |
| 5,411,114 | 5/1995 | Bedi et al. . | |
| 5,472,025 | 12/1995 | Conrad et al. | 141/384 |
| 5,490,545 | 2/1996 | Sokoloff et al. | 141/319 |

FOREIGN PATENT DOCUMENTS

| | | | |
|---|---|---|---|
| 2048921 | 2/1993 | Canada | 141/319 |

*Primary Examiner*—J. Casimer Jacyna
*Attorney, Agent, or Firm*—Haverstock, Garrett and Roberts

[57] ABSTRACT

The present device is a connector device designed to connect two tubes or containers so as to allow the transfer of fluids from one tube or container to the other. The connector device includes a tubular member made from an elastic material, with the tubular member having an inner wall that includes longitudinal slits. The tubular member can be made from one individual tube or a pair of joined flanged tubes. The flanged tubular members are joined at the flange positions and held together by a collar member. Furthermore, a plurality of individual tubular members can be placed in a rectangular frame member so that the tubular members are perpendicular and integral to the frame member.

3 Claims, 2 Drawing Sheets

CONNECTOR DEVICE FOR HOLDING TWO NECKS IN AN ABUTTING RELATIONSHIP

FIELD OF INVENTION

The present invention relates to a connector device designed to hold two necks, each attached to a tube or container, in an abutting relationship. The connector device includes a tubular member made of elastic.

BACKGROUND OF THE INVENTION

Devices have been known which are used to allow the transfer of fluids from one container or tube to another. However, the known devices have suffered from a variety of disadvantages. First, the known devices tend to have only one non-flexible inner wall diameter so that the devices are not readily adjustable so as to receive different sized articles such as a neck on a tube. None of the known prior art devices disclose a member made of elastic having longitudinal slits that allow the device to expand around a neck thereby allowing the device to receive necks of different diameters. Thus, none of the known prior art devices appear to be readily expandable so as to receive different dimensioned articles.

Additionally, a problem associated with devices used to transfer fluids from one container to another is that the diameters of the necks of the two containers may be different than the diameter of the device used to transfer the fluids from one device to another. Thus, if the diameters of the necks or similar structures of the containers are too large or too small, then the fluid transfer device will not work because it will be too small to receive a container's neck or too large to adequately hold the neck in place. Because of this drawback it is desirable to have a device that can receive necks of different diameters.

A final problem is that occasionally the two necks that are to be brought together have significantly different diameters. This makes it difficult to transfer fluids from one neck to the other because the diameter of one container is substantially larger than the diameter of the other container. Consequently, it is difficult to transfer liquids or fluids from one container to the other because the device used to transfer fluids is not designed to receive necks having different diameters. Thus, it would be advantageous to have a device that allows for the transfer of fluids between a pair of necks having significantly different diameters.

SUMMARY OF THE INVENTION

The present invention is for a connector device designed to hold the necks of a pair of containers or tube like structures in an abutting relationship so that fluids and/or liquid substances can pass through the necks from one container to the other. In particular, the present connector device prevents a pair of necks from separating when fluids are passed therethrough, including viscous fluids that require more pressure to be forced from one neck to the other.

The connector device includes a tubular member made from a singular continuous tubular member or a pair of flanged tubular members connected to one another. The tubular member will include an inner wall that forms a bore and an outer wall opposite the inner wall. The inner wall also includes at least one longitudinal slit which extends at least half the length of the tubular member. An elastic material, such as a thermoplastic, is used to make the tubular member so that the elastic material, in combination with the longitudinal slit or slits, will allow the tubular member to stretch around a pair of necks so as to securely hold the necks in an abutting relationship. It is advantageous for the tubular member to stretch around the necks because this allows the tubular member to receive and hold in place necks having different diameters.

A further embodiment that can be added to the tubular member is for the inner wall to have a threaded construction so that the tubular member can receive a threaded neck or pair of threaded necks. The threaded arrangement is desirable because it allows for the tight receipt of a threaded neck or a pair of threaded necks.

Multiple individual tubular members having different inner wall diameters can be joined together by a device designed to hold the individual tubular members together in a collective arrangement. The individual tubular members besides having different inner wall diameters may have different sized threading. The preferred construction for holding the multiple individual tubular members in place is a rectangular frame member that is integral with and perpendicular to the tubular members. Generally, the rectangular frame member will be made out of the same elastic thermoplastic material as the tubular members. However, other compositions which differ from the compositions used to make the tubular members may be used to make the frame member. The collective arrangement is advantageous because it allows a user to chose one of a plurality of tubular members having different inner wall diameters so that a tubular member can be chosen that best receives a pair of necks to form a more integral fit between the tubular member and the necks.

An alternative embodiment to the connector device having a tubular member made from a singular tubular member is to form the tubular member of the connector device from a pair of adjoined flanged tubular members, with each flanged tubular member having a perpendicular flange. The two flanged tubular members are joined together at the flange position so that the flanges abut one another. Once the flanged tubular members abut one another they are held in place by a collar that may have a singular or multi-piece construction. The collar preferably includes a pair of collar members each having a channel or recess designed and dimensioned to receive and hold in place the flanges of the tubular members. The flanged tubular members are advantageous because multiple members can be made having different inner wall diameters so that two flanged tubular members can be adjoined to one another with each member having a different inner wall diameter allowing for the receipt of two necks of different diameters. Thus, for example, a very small neck can have fluid transferred to it from a container or tube having a significantly larger neck.

SPECIFICATION

Figure 1:
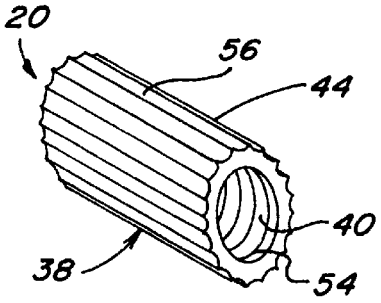
FIG. 1 is a perspective view of a tubular member of the present connector device.
Figure 4:
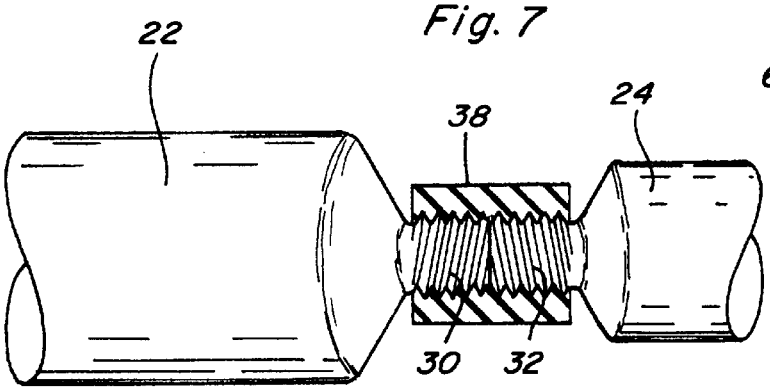
FIG. 4 is a cut-away partial side view of a pair of tubes having necks being held in abutting relationship by the connector device.
Figure 3:
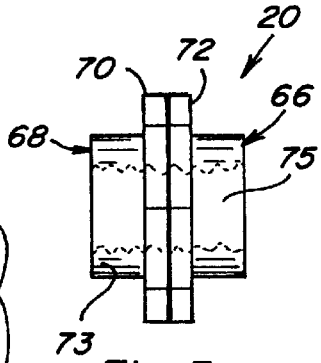
FIG. 3 is a side view of a pair of flanged tubular members coupled to one another of the present connector device.
Figure 5:
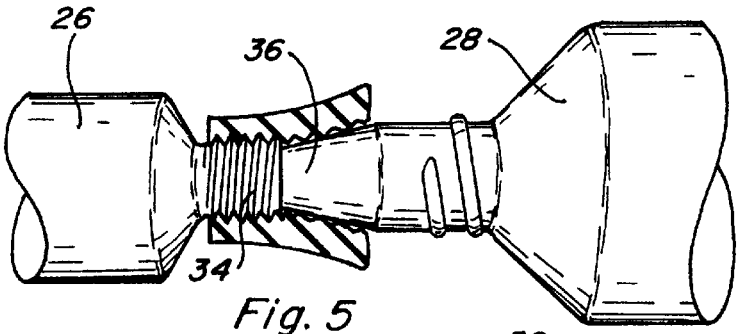
FIG. 5 is a partial cut-away side view of a pair of tubes having different necks being held in abutting relationship by the connector device.
Figure 2:
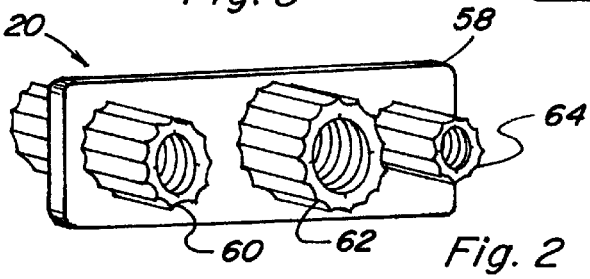
FIG. 2 is a perspective view of a frame member having three perpendicular tubular members of the present connector device.

This invention relates to a connector device 20 depicted in FIGS. 1, 2, and 3, which allows the transfer of fluids and like substances from one container 22 to another 24 having necks 30 and 32 of the same size as shown in FIG. 4, or from one container 26 to another 28 having necks 34 and 36 of a different diameter as shown in FIG. 5. Each neck 30, 32, 34, and 36 pictured has an opening and a passage. Fluids are transferred from one container or tube 22 to another 24 or from 26 to 28, when the openings in a pair of necks or like structures 30 and 32 or 34 and 36 are placed in an abutting relation so that the necks are in contact or very close to one another. By placing the necks, as shown in FIGS. 4 and 5, of two tubes or containers in an abutting relationship fluids can flow from one tube to the other through the respective necks. This is beneficial because it allows a user to transfer fluids, such as toothpaste, from a full large tube to an empty small or travel size tube. Unfortunately, it is difficult to hold a pair of necks attached to tubes in an abutting relationship so that the contents from one tube can be transferred to the other tube. Thus, a device that allows the necks to be held in contact so as to allow the contents to be transferred from one container to the other is desirable. The present connector device 20 fulfills this need by holding a pair of the necks 30, 32, 34, and 36 in place so that when one container or tube is actuated the fluid from that container is transferred into another container having a neck abutting the neck of the container being actuated. Importantly, the present connector device 20 securely holds a pair of necks in an abutting relationship so that when the fluid is transferred the necks are not separated or pushed away from one another.

Figure 7:
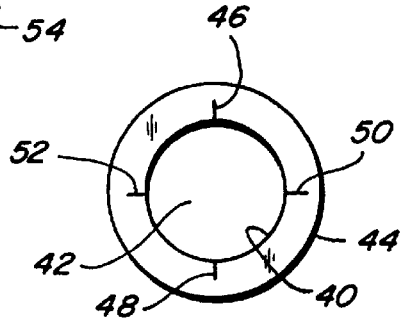
FIG. 7 is a front view of the tubular member without serrations.
Figure 6:
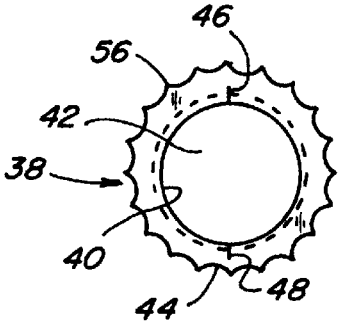
FIG. 6 is a front view of the tubular member having external serrations.

One embodiment of the connector device 20 includes a tubular member 38 pictured in FIGS. 1, 6, and 7 made from an elastic material. Use of the elastic material is advantageous because it allows the tubular member 38 to readily receive and grip a pair of the necks 30, 32, 34, and 36 and to prevent the necks from disassociating from the connector device 20. Thus, when a pair of the necks 30, 32, 34, and 36 are placed in the elastic tubular member 38, the tubular member may expand to tightly form around the pair of necks. The tubular member 38 includes an inner wall 40 that forms a bore 42 and an outer wall 44 opposite the inner wall, shown in FIGS. 1, 6, and 7. The inner wall 40 contains at least one and preferably a pair of longitudinal slits 46 and 48 which extend at least a half of the length of the tubular member 38. It is more preferred for the slits 46 and 48, shown in FIG. 7, to extend the length of the tubular member 38. Additionally, it is more preferred for the inner wall 40 to have, as shown in FIG. 7, a plurality of longitudinal slits 46, 48, 50, and 52. The longitudinal slits are desirable because they allow the tubular member 38 to readily expand allowing for the receipt of different sized necks 34 and 36, as shown in FIG. 5. The longitudinal slits are also desirable because they allow the threads 54 of the inner bore to more readily adapt to slightly different threading on different product necks. Thus, the longitudinal slits 46, 48, 50, and 52 in combination with the elastic material allow the tubular member 38 to expand so as to receive a pair of necks having a larger diameter than the diameter of the inner wall 40. An example of the use of the present connector device is shown in FIG. 4 and involves the transfer of tooth paste from a commercially available sized tube of tooth paste 22 to an empty travel size tube of tooth paste 24. As can be seen from FIG. 4, the tubular member 38 of the present connector device 20 holds the necks 30 and 32 in an abutting relationship, so that when the commercial size tube of tooth paste 22 is squeezed, tooth paste is transferred to the travel size tube of tooth paste 24.

The elastic material used to make the tubular member 38 is selected from any thermoplastic which can be stretched to form a tight fit around various sized necks and like devices. Additionally, the thermoplastic must not result in the transfer of hazardous substances from the tubular member 38 to the fluids passing through the tubular member. The most preferred thermoplastic used to make the tubular member will be an elastic material approved by the FDA for hygenic use so that the material is safe for human exposure and is flexible which thereby allows the tubular member 38 to form a tight fit around a pair of necks 34 and 36 as shown in FIG. 5.

The tubular member 38, as is shown in FIGS. 1, 4, 5, and 6, may include threads 54 located on the inner wall 40 which allow the tubular member to easily receive a threaded neck 30, 32 and 34 as depicted in FIGS. 4 and 5. While it is preferred for the inner wall 40 to be threaded, the inner wall may instead have a non-threaded smooth construction. Another embodiment can include an inner wall that is partially threaded, with the other half of the inner wall being non-threaded or smooth. Also, the threads 54 can be varied in size to more readily fit a particular neck having a certain thread size. Regardless of whether the inner wall is threaded, the tubular member can still receive non-threaded nozzle members because of the fact that it has slits and is made of an elastic material which allows the tubular member to stretch and form around a neck 36, as shown in FIG. 5.

Besides having threads 54, the tubular member 38 may include external gripping means 56 located on the outer wall 44. The gripping means 56 allows the user of the connector device 20 to more easily hold the tubular member 38 when inserting a pair of necks therein. Preferably, the gripping means 56 will be a plurality of longitudinal serrations as shown in FIG. 1; however, a webbing design may be used as well as any external design that allows a user to readily grip the tubular member when placing a pair of necks into the connector device 20.

The inner wall 40 has a diameter ranging from about 0.25 inches to about 1 inch, with the most preferred diameter being about 0.5 inches. The inner wall diameter can be varied to more specifically fit a particular neck size; thus, while a diameter of 0.5 inches is preferred, other diameters may be selected to more readily fit a particular neck diameter. The selected diameter of the inner wall 40 will depend in part on the diameter of the typical neck to be inserted into the tubular member 38. The length of the tubular member 38 generally ranges from about 0.5 inch to about 2 inches, with the most preferred length ranging from about 0.75 inch to about 1 inch. The length of the tubular member 38 is important because it must be of a sufficient length to hold a pair of necks in place, but not too long otherwise it will prevent the necks from abutting one another. The tubular member 38 will have a thickness measured between the inner wall and the outer wall of between about 0.125 inches and about 0.75 inches.

The connector member 20 may include a frame member 58, shown in FIG. 2, integral with a plurality of individual tubular members 60, 62, and 64 which are similar to tubular member 38. The number of individual tubular members located in the frame member 58 can vary dependent upon the desired final use of the connector device 20. The tubular members 60, 62, and 64 will generally have the same construction and dimensions as tubular member 38, except that the tubular members 60, 62, and 64 will all have different inner wall diameters so as to more readily receive necks of different diameters. The inner wall diameters will still range between about 0.25 inches and about 1 inch and the length of the tubular members will range between about 0.5 inches and about 2 inches. Thus, the individual tubular members 60, 62, and 64 are made of the same materials, have the same construction, and generally have the same dimensions as tubular member 38. The frame member 58 may be made from any material that allows the frame member to be attached to and hold in place the individual tubular members 60, 62, and 64. However, preferably the frame member is made out of the same or similar material as the individual tubular members. Because the frame member is preferably made out of the same material as the individual tubular members, the frame member will preferably be made from a thermoplastic material. In its preferred construction the frame member 58 is a substantially planer rectangular member that is integral and perpendicular to the individual tubular members 60, 62 and 64. The different inner wall diameters of the individual tubular members allow for the easier receipt by the connector device of necks having different diameters. It should be mentioned that the frame member can be of any dimension, size, or shape so long as it readily receives, is integral with, and holds in place the individual tubular members.

Figure 8:
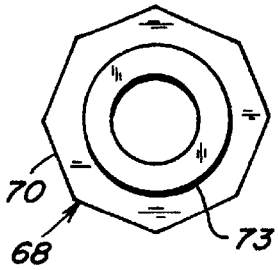
FIG. 8 is a front view of one of the flanged tubular members.
Figure 9:
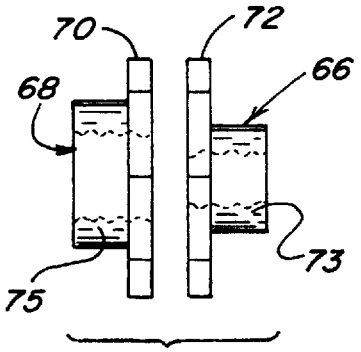
FIG. 9 is a side view of a pair of the flanged tubular members having different inner wall diameters.

Another embodiment includes a tubular member that is not a singular unitary device 38 as shown in FIGS. 1 and 4, but is instead a pair of flanged tubular members 66 and 68 which are coupled to one another and form the tubular member shown in FIGS. 3 and 8. Regardless of whether the tubular member is a unitary member or a pair of connected flanged members, it includes an inner wall and an outer wall, with the inner wall forming a bore and having at least a pair of longitudinal slits. The flanged tubular members each include a flange 70 and 72 perpendicular to a pair of tubes 73 and 75 which form the respective flanged tubular members 66 and 68, shown in FIGS. 3 and 9. The flanged tubular members 66 and 68 are designed to be joined to one another so that the flanges 70 and 72 abut one another and allow the flanged tubular members to become attached so as to form a unitary tube. Use of the flanged tubular members 66 and 68 is desirable because different flanged tubular members can be manufactured having tubes with different inner wall diameters so that a pair of flanged tubular members can be coupled to one another with each flanged tubular member having a different inner wall diameter allowing the connector device 20 to more readily receive a pair of necks having different diameters. The flanged tubular members having different inner wall diameters are shown in FIG. 9. Thus, the use of the flanged tubular members is desirable because a user can more readily transfer substances or fluids between necks having different diameters.

Like the unitary tubular member 38, the flanged tubular members will each have an inner wall diameter ranging between about 0.25 inches and about 1 inch. When the flanged tubular members are coupled the total length of the two members will range between about 0.5 inches and about 2 inches.

Figure 10:
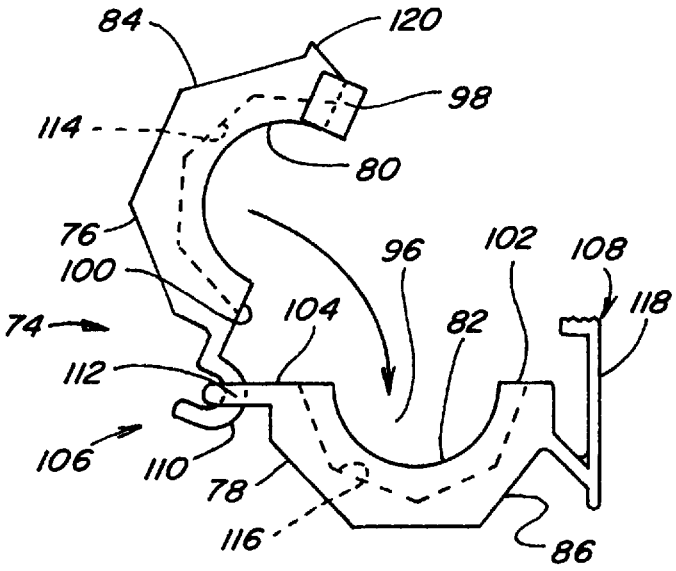
FIG. 10 is a front view of a collar having a pair of collar members pivotally attached to one another.
Figure 11:
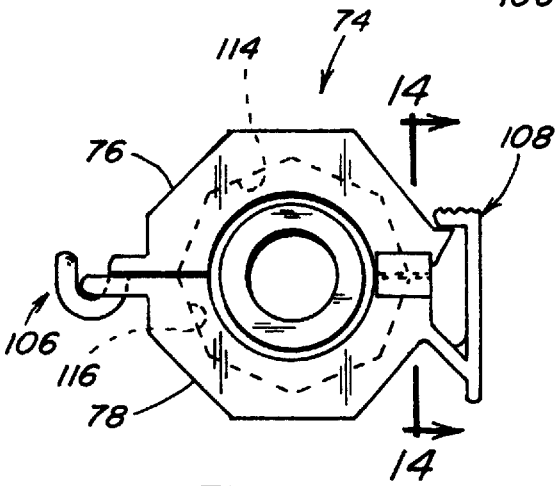
FIG. 11 is a front view of the collar engaging the flanged tubular members.
Figure 14:
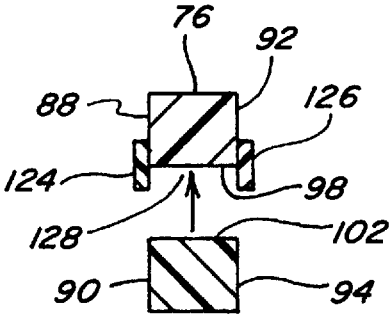
FIG. 14 is a cut-away side view of the collar member showing a pair of side walls.

Once the flanged tubular members 66 and 68 are coupled to one another, means are necessary to maintain the flanged tubular members in a coupled relationship. Any means that adequately holds the two flanged tubular members together can be used. It is preferred, however, to use a collar 74 to hold the two flanged tubular members 66 and 68 together. The collar 74 as shown in FIGS. 10, 11, 12, and 13 can have a variety of constructions. The preferred collar construction includes a pair of collar members 76 and 78 which preferably have a semi-circle shape and are depicted in FIGS. 10 and 11. The collar members 76 and 78, each have an inner collar edge 80 and 82 and an outer collar edge 84 and 86. Additionally, the collar members 76 and 78 each have a front collar wall 88 and 90 and a back collar wall 92 and 94 shown in FIG. 14. When the collar members 76 and 78 are joined the inner collar edges 80 and 82 form a collar space 96, which allows the flanged tubular members 66 and 68 to project outward from the collar 74. Additionally, each collar member 76 and 78 has a pair of collar feet so that collar member 76 has collar feet 98 and 100, and collar member 78 has collar feet 102 and 104, which are shown in FIGS. 10 and 14. When the collar members 76 and 78 are joined they will hold in place the flanged tubular members 66 and 68. Preferably, the collar members 76 and 78 have a pivotal attachment 106 on one side and means having cooperatively engageable members for fixedly securing the collar members in place 108 on the side opposite the pivotal attachment, as shown in FIGS. 10 and 11. The pivotal attachment 106 preferably includes a hook 110 attached to one collar member 76. The hook 110 is received by an eyelet 112 that is part of the other collar member 78. The pivotal attachment 106 keeps the two collar members 76 and 78 together and allows the collar members to close over and hold in place the flanged tubular members 66 and 68. It is recognized, however, that other pivotal attachments may be used such as a hinge relationship.

Collar member 76 includes a channel 114 located between the front collar wall 88 and the back collar wall 92 that starts at the inner collar edge 80 and extends the entire length of the inner collar edge 80. Collar member 78 also has a channel 116 located between the front collar wall 90 and the back collar wall 94 and that starts at the inner collar edge 82 and also extends the entire length of the inner collar edge 82. Both channels 114 and 116 are shown in FIGS. 10 and 11 and are designed and dimensioned to receive and hold in place the flanges 70 and 72. It is preferred for the channels 114 and 116 to be of the same shape as the flanges 70 and 72 as this allows the collar members 76 and 78 to more readily hold the flanges 70 and 72 in place. Typically, the flanges 70 and 72 are either an octagonal, hexagonal, or square shape which means the channels 114 and 116 will have an octagonal, hexagonal, or square shape when the collars 76 and 78 are joined to one another. The octagonal shaped flanges and channels are shown in FIGS. 8, 10, and 11.

Preferably, the depth of each of the channels 114 and 116 in the collars 76 and 78 is equal to about ⅜ of an inch. Additionally, the collar space 96 has a diameter of approximately ⅞ of an inch.

Figure 12:
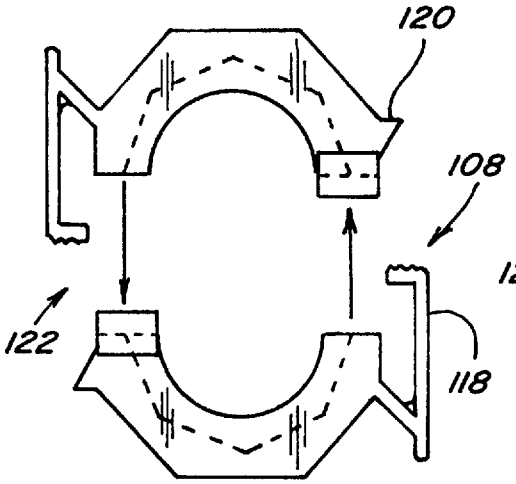
FIG. 12 is a front view of the collar with the collar members having a pair of pawls and a pair of triangular protuberances.
Figure 13:
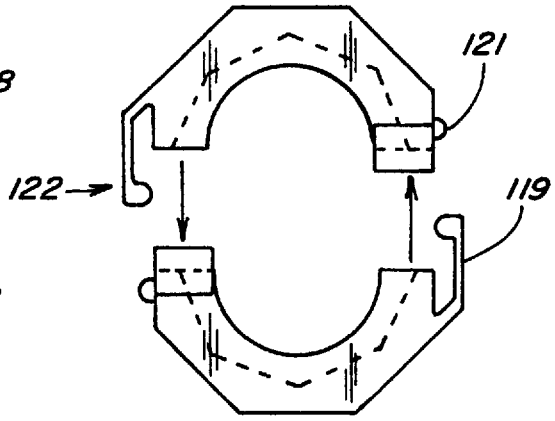
FIG. 13 is a front view of the collar with the collar members having a pair of pawls and a pair of knob protuberances.

The means having cooperatively engageable members for fixedly securing the collar members in place 108 can be any means that allows the collar members 76 and 78 to be held in place once they are joined together around a pair of flanged tubular members 66 and 68. The preferred construction for the means for securing the collar members 108 includes a pawl 118 and a protuberance 120. The protuberance 120 can have a triangular shape, as shown in FIGS. 10 and 12, or may be a knob 121 as shown in FIG. 13. Also, pawl 119 interacts with protuberance 121. When the means for securing the collar members 108 is engaged to hold the collar members 76 and 78 in place, the pawl 118 will be engaged with the protuberance 120 thereby holding the collar members in place. The pawl 118 engaged with the protuberance 120 to hold the collar members in place is pictured in FIG. 11.

Another embodiment in the collar 74 replaces the pivotal attachment 106 with means for fixedly securing the collar members 122. The means for fixedly securing the collar members 122 will have essentially the same structure as means 108 as shown in FIGS. 12 and 13.

An additional retaining wall embodiment may be added to at least one of the collar members 76 and 78. The embodiment is a pair of spaced opposed retaining walls 124 and 126 which define a space 128 adapted to receive and hold in place the collar member opposite the collar member on which the retaining walls are attached, shown in FIG. 14. The retaining walls 124 and 126 prevent the collar members from moving in a lateral direction and sliding apart from one another. The retaining walls 124 and 126 are attached to the front collar wall 88 and the back collar wall 92 of the collar member 76. A further embodiment can include an additional pair of retaining walls so that two pair of retaining walls are used to prevent the movement of the two collar members as shown in FIGS. 12 and 13.

In another embodiment the tubular member can, instead of being made from an elastic material, be constructed out of a rigid plastic material to form a rigid tubular member. The rigid tubular member can be either the singular tubular member or the pair of flanged tubular members. Regardless of whether the tubular member is a singular member or pair of flanged members, the rigid tubular member will include threads because the rigid tubular member will be designed to specifically and integrally receive a neck or pair of necks. In other words, the threads of the rigid tubular member will be made to receive a specific existing threaded neck.

A final alternative embodiment can include at least one slit located on the outer wall of the tubular member.

Thus, there has been shown and described a novel connector device for holding a pair of necks in an abutting relationship which fulfills all the objects and advantages sought therefore. It is apparent to those skilled in the art, however, that many changes, variation, modification, and other uses and applications for the subject device are possible, and also such changes, variations, modifications, and other uses and applications which do not depart from the spirit and scope of the invention are deemed to be covered by the invention which is limited only by the claims which follow.

What is claimed is:

1. A connector device for holding in place a pair of necks so as to allow fluid to be transferred from one container to another, wherein said connector device includes at least one elastic tubular member having an inner wall, an outer wall opposite said inner wall, and a bore formed by said inner wall with said inner wall being of sufficient diameter to receive and hold in place a pair of necks attached to a pair of containers, said inner wall having at least one longitudinal slit adapted to expand to accommodate different sized necks so that when the necks are placed in said elastic tube member said tube member will expand to grip the necks allowing one neck to abut the other and transfer fluids from one container to the other.

2. A connector device for holding in place a pair of necks so as to allow fluid to be transferred from one container to another, wherein said connector device includes at least one elastic tubular member having an inner wall, an outer wall opposite said inner wall, and a bore formed by said inner wall with said inner wall being of sufficient diameter to receive and hold in place a pair of necks attached to a pair of containers, said inner wall having at least one longitudinal slit so that when the necks are placed in said elastic tube member said tube member will expand to grip the necks allowing one neck to abut the other and, wherein said connector device is made of a unitary elastic tubular member having a threaded inner wall which forms a bore, said inner wall designed to receive a pair of necks attached to a pair of containers with the necks being threaded so that the threaded members of each container will abut one another within said inner wall thereby allowing the transfer of fluid from one container to the other.

3. The connector device of claim 2 wherein said connector device has gripping means on said outer wall.

* * * * *